US012800141B2

(12) United States Patent
Maroccolo

(10) Patent No.: US 12,800,141 B2
(45) Date of Patent: Nov. 17, 2026

(54) PREMIXED GAS HEATING SYSTEM FOR $H_2$

(71) Applicant: FERROLI S.P.A, San Bonifacio (IT)

(72) Inventor: Alessandro Maroccolo, Verona (IT)

(73) Assignee: FERROLI S.P.A., San Bonifacio (IT)

( * ) Notice: Subject to any disclaimer, the term of this patent is extended or adjusted under 35 U.S.C. 154(b) by 343 days.

(21) Appl. No.: 18/571,870

(22) PCT Filed: Jun. 17, 2022

(86) PCT No.: PCT/IB2022/055632

§ 371 (c)(1),
(2) Date: Dec. 19, 2023

(87) PCT Pub. No.: WO2022/269433

PCT Pub. Date: Dec. 29, 2022

(65) Prior Publication Data

US 2024/0302038 A1 Sep. 12, 2024

(30) Foreign Application Priority Data

Jun. 21, 2021 (IT) ..... 102021000016193

(51) Int. Cl.
*F23D 14/02* (2006.01)
*F23D 14/70* (2006.01)
*F23N 5/24* (2006.01)

(52) U.S. Cl.
CPC ..... *F23D 14/02* (2013.01); *F23D 14/70* (2013.01); *F23N 5/242* (2013.01);
(Continued)

(58) Field of Classification Search
CPC ..... F23D 14/02; F23D 14/70; F23N 5/242
(Continued)

(56) References Cited

U.S. PATENT DOCUMENTS

2010/0095905 A1* 4/2010 Smelcer ..... F23D 14/34 122/18.1
2020/0386482 A1 12/2020 Giannoni

FOREIGN PATENT DOCUMENTS

EP 0645582 A2 3/1995
EP 2037175 A2 3/2009
(Continued)

OTHER PUBLICATIONS

International Search Report and Written Opinion on Patentability in PCT/IB2022/055632, mailed Oct. 7, 2022.
(Continued)

*Primary Examiner* — Vivek K Shirsat
(74) *Attorney, Agent, or Firm* — United IP Counselors, LLC

(57) ABSTRACT

A premixed gas heating system comprises: a fan assembly (2) configured to supply a premixed air-gas flow required for combustion, wherein a combustible gas of the premixed air-gas flow contains at least 20% by volume of hydrogen; a burner (5) comprising a plurality of holes, wherein the plurality of holes provides a free passage area defined as an area that allows the outflow of the premixed air-gas flow from an area upstream of the burner (5) to an area where flames of combustion are generated; a load controller, configured to regulate an output load of the burner (5) such that the heating system modulates between a minimum load and a maximum load, wherein a ratio between the minimum load and the maximum load is at least 4, wherein the minimum load of the heating system is set such that a combustion index, defined as the ratio between the minimum load and the free passage area of the burner, is between 4 E06 and 6 E07.

20 Claims, 9 Drawing Sheets

(52) U.S. Cl.
CPC ..... *F23C 2900/9901* (2013.01); *F23D 2203/1017* (2013.01); *F23D 2203/1023* (2013.01)

(58) Field of Classification Search
USPC ..... 431/2, 326–329
See application file for complete search history.

(56) References Cited

FOREIGN PATENT DOCUMENTS

| | | | | |
|---|---|---|---|---|
| EP | 3690345 | A1 | 8/2020 | |
| EP | 3770528 | A2 | 1/2021 | |
| WO | WO-9523315 | A1 * | 8/1995 | ..... F23D 14/02 |
| WO | 2009059933 | A1 | 5/2009 | |
| WO | 2020079445 | A1 | 4/2020 | |
| WO | 2020182902 | A1 | 9/2020 | |

OTHER PUBLICATIONS

Third Party Observation on Patentability Submitted Sep. 13, 2023 in PCT/IB2022/055632.

* cited by examiner

PREMIXED GAS HEATING SYSTEM FOR $H_2$

TECHNICAL FIELD

This invention relates to a combustion cell for a heating system, in particular, a premixed gas burner The invention also relates to methods for operating and manufacturing a premixed gas heating system.

The heating system has the purpose of a boiler. The invention also relates to a method for heating water in a heating system.

BACKGROUND ART

A boiler is a device in which water to be heated flows through a heat exchanger acting in conjunction with a gas burner. There are prior art boilers for producing hot water. The boilers for domestic use usually have inside them a combustion cell consisting of a base element and an outer jacket, defining inside them a combustion chamber housing a heat exchanger passed through by the fluid to be heated.

Usually, the heat exchanger is made from a tube wound in the form of a coil and is positioned close to the outer jacket.

The outer jacket is closed, at one end, by the base component and, at the opposite end, by a lid through which an unburnt premixed air-gas mixture flow from a fan unit.

The boilers with a premixed gas burner typically have a system for mixing and delivering gaseous fuel and comburent air, a system for conveying the air-gas mixture and a head of the burner, on whose outer surface the flames are generated.

The boilers also comprise a duct configured to carry said unburnt air-gas mixture from the fan unit to the burner.

The high temperature fumes produced by the flames originating on the head of the burner are made to flow through the heat exchanger to transfer heat to the fluid passing through the heat exchanger.

Patent documents US2020386482A1, EP3770528A2 and EP3690345A1 describe examples of combustion cells for a prior art boiler.

In these combustion cells, due to the presence of the flames on the head of the burner, the burner heats and there may therefore be an unwanted transfer of heat to the elements positioned upstream of the burner, in particular the lid of the cell. The cell described in the above-mentioned documents therefore comprises an insulating material to prevent overheating of the elements upstream of the burner. Said insulating material has a limited life span, since it is constantly exposed to very high temperatures, so it is therefore necessary to replace periodically. On the other hand, the use of this insulating material leads to a more bulky product and a higher cost.

For this reason, there is the need to make a combustion cell which can be cooled without using said insulating material in order to keep the cell in the most compact form possible and to reduce the construction and maintenance costs.

In this context, patent document WO2015150902A1 describes a premixed gas burner comprising a flange, a conveyor, a burner head and a distributor positioned between the head of the burner and the conveyor, wherein said burner is closed in a pack between the flange and the conveyor and wherein during operation of the burner, a mixture of air and fuel gas flows through the conveyor, which, through the distributor, reaches the head of the burner to create a flame on an outer surface of the head of the burner. Said distributor has a plurality of holes of different sizes, whilst the head of the burner comprises a peripheral zone free of holes and a perforated central zone. Consequently, the mixture of air and gas flowing from the distributor element towards the head of the burner comes into contact with the peripheral zone of the head of the burner and creates a circulation which leads to the cooling of the burner.

The above-mentioned invention provides a solution for cooling the head of the burner without the need to use the insulating material. However, this invention does not provide any solution for cooling the conveyor in direct contact with the burner and the distributor. For this reason, there is a need to provide a better cooling.

Another problem with conventional combustion cells relates to the fact that in these cells, said duct is formed completely in the conveying element (that is to say, the lid), connecting the fan unit to the latter. This configuration increases the overall size of the cell and forces the removal of the fan unit every time it is necessary to remove the door to access the burner or the combustion chamber. Patent document EP2306112A1 provides another example of combustion cells. In addition, the burners used in conventional cells are natural gas burners. However, the use of these burners is criticised due to carbon dioxide emissions which may lead to serious environmental impacts. The use of gas burners which use 100% hydrogen or mixtures of natural gas with hydrogen constitutes an interesting solution to reduce carbon dioxide emissions. However, the hydrogen or gaseous fuels with a significant hydrogen content have a combustion behaviour different from natural gas. The different combustion behaviour leads to a series of problems, for example the burner is subject to backfire.

Patent document WO2020182902A1 describes a method for using a premixed gas burner which is able to modulate between a minimum load and a full load, wherein the fuel gas supplied to the burner comprises at least 20% by volume of hydrogen. Moreover, patent document WO9523315A1 describes another example of known modulating heating systems. However, in this sector there is an increasingly strongly felt need to make a heating system which is able to use hydrogen with a greater efficiency and a method for use of the heating system.

DISCLOSURE OF THE INVENTION

The aim of the invention is to provide a combustion cell for a heating system and a method for heating water in a heating system which overcome the above-mentioned drawbacks of the prior art.

In particular, the aim of the invention is to provide a combustion cell for a heating system which is easier to access and maintain with an improved cooling capacity without using insulating materials and a smaller overall size, maintaining a high level of reliability and a relative ease of production at competitive costs.

A further aim of the invention is to provide a modulating heating system and a method for using it which is able to operate in a stable, controlled and efficient manner with air-H2 mixtures.

Said aim is fully achieved by the combustion cell for a heating system and the method according to the invention as characterised in the appended claims.

According to an aspect of the invention, the invention provides a combustion cell for a heating system. The combustion cell can also be defined as “heat exchange cell”.

The combustion cell comprises a fan unit (also denominated "fan assembly" in the present description). The fan unit is configured to supply a flow of premixed air-gas required for the combustion.

It should be noted that the fan unit comprises a fan, which includes an impeller (with a respective volute and, if necessary, a diffuser) and an electric motor which rotates it. The fan unit also comprises a gas supply and an air intake; the gas supply may be located upstream or downstream of the fan.

The combustion cell comprises a combustion chamber. The combustion chamber extends preferably along a longitudinal axis from a first end to a second end. The combustion cell (that is to say, the cell) comprises a lid. The lid is configured for closing the first end of the combustion chamber. The cell comprises a burner. Combustion flames are generated on an outer surface of the burner. According to an example, the burner has a convex shape. This shape allows a mechanical stability of the burner without deformations due to the thermal load. Moreover, this shape leads to an optimum distribution of the flame avoiding the superposing of the individual flames, contributing to a cleaner combustion. According to another example, the burner may have a flat shape.

The burner includes a central zone (also denominated "central region" in the present description). The central zone of the burner is perforated. The burner may also include a peripheral zone (also denominated "peripheral region" in the present description). The peripheral zone of the burner is free of holes. The cell also comprises a distributor. According to an example, the distributor has a convex shape. The convex shape of the burner and of the distributor makes it possible to reduce the axial dimensions of an assembly formed by the burner and the distributor, further compacting the assembly. The distributor comprises a peripheral part (also denominated "peripheral zone" in the present description) provided with apertures. The distributor is located upstream of the burner. The distributor is configured for supplying the flow of premixed air-gas to the burner. The burner is positioned in such a way that the peripheral part of the distributor faces towards the peripheral zone of the burner. This configuration makes it possible to create a circulation of the air-gas flow between the peripheral zone of the burner and the peripheral part of the distributor which leads to the cooling of the burner. The cell may comprise a flange. The flange is configured for connecting the lid to the burner. The cell comprises a heat exchanger. The heat exchanger is preferably made from a tube wound in the form of a coil. The coil is arranged around the longitudinal axis to surround the combustion chamber. The coil has a plurality of spirals (also denominated "wrap" in the present description). A first spiral of the plurality of spirals of the coil is proximal to the burner. A last spiral of the plurality of spirals of the coil is distal to the burner. According to an example, the flange has a receiving surface for receiving the first spiral of the coil to exchange heat in direct contact with it. This configuration makes it possible to have a large contact surface between the flange and the first spiral of the coil to exchange heat which protects the flange, exposed to the hot flames of the burner, from overheating since there will be heat exchange between the flange and the heat exchanger. For this reason, it is possible to optimise the cooling of the burner and the elements downstream of the burner and prevent overheating without the use of insulating material. According to an example, a minimum absolute (also denominated "overall" in the present description) distance between the coil to exchange heat and the burner varies with respect to the angular position around the longitudinal axis, between a minimum value and a maximum value. The minimum value of the absolute minimum distance is less than 15 mm. The maximum value of the minimum absolute distance is less than 25 mm. The minimum value of the absolute minimum distance is preferably less than 8 mm. The maximum value of the absolute minimum distance is preferably less than 18 mm. According to an example, a minimum axial distance between the coil to exchange heat and the burner along the longitudinal axis varies between a minimum value and a maximum value. The minimum value of the minimum axial distance is less than 20 mm. The maximum value of the minimum axial distance is less than 30 mm. The minimum value of the minimum axial distance is preferably less than 12 mm. The maximum value of the minimum axial distance is preferably less than 22 mm. These minimum distances guarantee the most compact shape of the cell and allow a minimum portion of the flange to be obtained exposed to the hot flames of the burner which is advantageous since it protects the flange from overheating.

The burner and the distributor form a burner unit (also denominated as "burner assembly" in the present description). According to an example, the burner unit is connected to the flange through one or more connecting elements in a first connecting zone. The lid is fixed to the flange in a second connecting zone. The second connecting zone is distinct and spaced from the first connecting zone. This configuration makes it possible to protect the lid from overheating since there is no direct contact between the lid and the burner unit.

The cell also comprises a feeding chamber. According to an example, the feeding chamber is defined between the lid and the distributor. The flange may include an ear. The ear extends radially with respect to the longitudinal axis. The flange is configured to receive the fan unit connected thereto. This solution results in the possibility of accessing the combustion chamber by removing only the lid and thus provides for an easier maintenance. Alternatively, the fan unit may be positioned directly on the lid.

According to an example, said ear of the flange acts in conjunction with the lid to delimit a feeding duct. The feeding duct is configured for feeding the flow of premixed air-gas supplied from the fan unit to the feeding chamber. The flow of premixed air-gas flows in the combustion chamber in a forwards direction from the first end to the second end of the combustion chamber. According to an example, the feeding duct has an inlet situated in an outlet of the fan unit and an outlet open to the feeding chamber. Preferably, the premixed air-gas flow inside the feeding duct is oriented in an inlet direction having at least one component directed longitudinally in a direction opposite to the forward direction.

According to an example, the flow of premixed air-gas inside the feeding duct, at the outlet of the supply duct is oriented in an outlet direction having at least one component directed radially towards the longitudinal axis. This solution helps to further cool the lid when the air-gas flow comes into contact with the lid at the outlet of the feeding duct.

The lid has an inner surface. The inside surface of the lid delimits the combustion chamber. The inner surface of the lid is preferably provided, in a central zone, with a projection which protrudes into the feeding chamber, thus forming an annular shaped portion in the feeding chamber. The annular portion acts in conjunction with the apertures provided in the peripheral part of the distributor to provide a manifold for dispensing to the apertures of the peripheral part of the distributor the premixed air-gas supplied by the fan unit. This configuration makes it possible to guide the flow of air-gas towards the apertures of the peripheral part of the distributor and consequently leads to a better cooling of the burner.

It should be noted that the projection encloses a volume of air, positioned between the lid and the burner; this volume of air is in communication, by means of a hole, with the feeding chamber. Said volume of air also has the function of an acoustic resonator, to cut the undesired frequencies.

The cell may comprise a gasket for sealing the lid, provided between the lid and the flange. Said gasket for sealing the lid has a first portion and a second portion. According to an embodiment, the first portion of the gasket for sealing the lid is annular and is positioned around the longitudinal axis.

The second portion is preferably offset with respect to the longitudinal axis in contact with the ear of the flange.

The distributor may include a plurality of holes on its central part. According to an example, the holes of the plurality of holes in the central part of the distributor are of different sizes from those of the peripheral part. The holes with a smaller diameter than the apertures of the peripheral part of the distributor protect the lid from the radiation of the flames on the burner. Preferably, the apertures of the peripheral part form at least 60% of the total surface of the holes of the distributor. This solution allows a greater circulation of the flow of air-gas between the distributor the peripheral zone of the burner.

It should be noted that when reference is made in the invention to a "diameter" of a hole or of an aperture, this does not mean to limit to the fact that the hole or aperture has a circular shape, but it is meant, generically, that the area of the hole or of the aperture is equivalent to a circle having that diameter.

According to an aspect of the invention, a method is also provided for heating water in a heating system. The method comprises a step of providing a fan unit. The method comprises a step of providing a lid. The method comprises a step of providing a burner with a convex shape. The method comprises a step of providing a distributor with a convex shape.

The method comprises a step of providing a coil for exchanging heat. The coil to exchange heat extends around a longitudinal axis to surround a combustion chamber. The heat exchanger has a plurality of spirals comprising a first spiral proximal to the burner and a last spiral distal to the burner. The method comprises a step of providing a lid for closing a first end of the combustion chamber.

The method may comprise a step of providing the burner with a central perforated zone and a peripheral zone free of holes. The method may also comprise a step of providing the distributor with a peripheral part provided with apertures. The method comprises a step of positioning the distributor upstream of the burner, in such a way that the peripheral part of the distributor faces the peripheral zone of the burner. The method may comprise a step of providing a flange connected to the lid and to the burner. According to an example, the method comprises a step of providing the flange with a receiving surface. The receiving surface receives the first spiral of the coil to exchange heat in direct contact with it.

The method comprises a step of circulating water in the coil to exchange heat. The method comprises a step of providing a pre-mixture of fuel gas and air to the burner, through the distributor. The method also comprises a step of directly fixing a burner unit formed by the burner and by the distributor, to the flange. According to an example, the fan unit is connected to the flange, in such a way that it is possible to access the burner unit formed by the burner and by the distributor by removing the lid, without removing the fan unit. The method comprises a step wherein there is a feeding chamber between the lid and the distributor and wherein a flow of premixed air-gas is conveyed by the fan unit to the feeding chamber, through a duct delimited by the flange and by the lid. Preferably, the flow of premixed air-gas is conveyed to the feeding chamber with an orientation having a radial component directed towards the longitudinal axis, in such a way as to generate inside the feeding chamber a flow of air-gas which touches an inner surface of the lid.

According to an aspect of the invention, a premixed gas heating system is provided. In the present description, when referring to a premixed gas heating system, a surface stabilized premixed gas heating system is intended. The heating system may comprise a combustion cell according to one or more aspects of the invention irrespective of the fuel used.

The heating system comprises a fan unit. The fan unit is configured to supply a flow of premixed air-gas required for the combustion. According to an example, a fuel gas of the flow of premixed air-gas contains at least 20% by volume of hydrogen. Alternatively, the heating system may use a flow of natural gas.

The heating system comprises a burner. The burner includes a plurality of holes. Said plurality of holes in the burner provides a useful transit area (also denominated "free passage area" in the present description). The useful transit area defined as an area which allows the outflow of the flow of premixed air-gas from a feeding chamber upstream of the burner to a combustion chamber where combustion flames are generated. The heating system also comprises a load controller. The load control is configured for adjusting an outlet load (also denominated "output load") of the burner in such a way that the heating system modulates between a minimum load and a maximum load. In other words, the load controller regulates the output load of the heating system. According to an example, a ratio between the maximum load and the minimum load is at least 4. According to an example, the minimum load of the heating system is set in such a way that a combustion index is between 4 E06 and 6 E07. The combustion index is defined as a ratio between the minimum load and the useful transit area of the burner.

It should be noted that the expression "minimum load" means a minimum power load expressed in Watts. It should also be noted that the useful transit zone is an area which, in the context of the combustion index, is expressed in square metres.

According to another example, the combustion index of the heating system is between 8 E06 and 2 E07. The plurality of holes of the burner may include a first group of holes having a first diameter and a second group of holes having a second diameter. According to an example, the first diameter is smaller than the second diameter. Preferably, the second diameter is increased by at least 30% with respect to the first diameter. According to an example, an area covered by the second group of holes is less than 40% of the total useful transit area of the burner. According to an example, the ratio between the minimum load and the maximum load of the heating system is equal to 8. A greater value of the ratio between the minimum load and the maximum load reduces the constant switching on/off cycles of the heating system which negatively affect the efficiency of the heating system and lead to unnecessary wear of its components. According to an example, the fuel gas (also denominated "combustible gas" in the present description) of the flow of premixed air-gas supplied to the burner contains at least 60% by volume of hydrogen. According to another example, the fuel gas of the flow of premixed air-gas supplied to the burner is 100% hydrogen. This solution contributes to reducing the emissions of the heating system.

The burner may comprise a central zone and a peripheral zone. The central zone is perforated while the peripheral zone is free of holes. The system also comprises a distributor. According to an example, the distributor includes a peripheral part provided with apertures. The distributor is located upstream of the burner for feeding the flow of premixed air-gas to the burner. Preferably, the distributor is positioned in such a way that the peripheral part of the distributor faces towards the peripheral zone of the burner. This configuration leads to the cooling of the burner, since the flow of air-gas coming from the distributor comes into contact with the peripheral zone free of holes in the burner before leaving from the holes of the central zone of the burner and a circulation is created which is able to remove the heat from the burner.

The distributor may include a plurality of holes on a central part of it. According to an example, the holes in the central part of the distributor have dimensions different to those of the peripheral part. Preferably, the holes in the central part are smaller in diameter than the apertures of the distributor. Preferably, the apertures of the peripheral part form at least 60% of the total area of the holes of the distributor. This solution allows greater circulation of the air-gas flow between the peripheral part of the distributor and the zone without holes in the burner. According to an example, the burner has a cylindrical shape. Alternatively, the burner has a convex shape. The convex shape of the burner increases the mechanical stability of the component, avoiding deformations due to the thermal load. At the same time, the convex shape of the burner makes it possible to reduce the overall dimensions of the heating system.

According to an example, the central zone of the burner includes an inner part (also denominated "internal part" in the present description) and an outer part (also denominated "external part" in the present description). According to an example, the inner part of the central zone of the burner is free of holes. Moreover, according to an example, the outer part of the central zone of the burner is perforated. The outer part of the central zone of the burner may be an annular zone which surrounds the inner part of the central zone of the burner. Moreover, the inner part of the burner faces a perforated zone of the distributor.

Moreover, according to an example, the central part of the distributor includes a central inner part (also denominated "internal central part" in the present description) and a central outer part (also denominated "external central part" in the present description). According to an example, the central inner part and the central outer part are both perforated and may be separated by a zone free of holes. The zone of the distributor without holes may be an annular zone. According to an example, the central outer part of the distributor faces the outer part of the central zone of the burner, where there are the holes and, consequently, the flames. Moreover, the central inner part of the distributor faces the inner part, free of holes, in the central zone of the burner.

Moreover, according to an example, the outer part of the central zone of the burner is more extended than the central outer part of the distributor. In other words, the useful transit area of the burner is larger than that of the distributor.

For this reason, it is possible to optimise the cooling of the burner and improve the performance of the heating system.

In particular, according to an aspect of the invention, the holes in the central outer part of the distributor are aligned with those of the outer part of the central zone of the burner. For this reason, in the outer part of the central zone of the burner, where there are the flames, the flow of premixed air-gas passes directly through the holes of the distributor aligned with those of the burner with a sufficiently high speed; consequently, it is possible to supply the holes in the burner correctly so as to have a uniform distribution of the flames and increase the stability of the flames on the surface of the burner and prevent the flames from returning inside the combustion chamber.

Moreover, as shown in FIG. 9, in the peripheral zone of the burner free of holes and the inner part of the central zone of the burner, where the holes are not present, the premixed air-gas flow, coming from the distributor, comes into contact with the burner before leaving from the holes in the outer part of the central zone of the burner. For this reason, zones adjacent to the holes of the burner, where the temperatures are highest due to the flames, are cooled.

Moreover, the contact between the air-gas flow and the zones adjacent to the holes of the burner creates a turbulence in the movement of the air-gas mixture due to change of direction.

According to an example, the load controller has access to a memory. The memory contains a plurality of reference ranges for the value of the combustion index. Each reference range provides a range of efficiency modulation amplitude of the heating system. The load controller is programmed to provide a user with a plurality of operating modes.

Each operating mode of the plurality of operating modes corresponds to a respective range of the plurality of reference ranges. The load controller is programmed for setting the minimum load of the heating system to a value in the reference range corresponding to the operating mode selected by the user. According to an aspect of the invention, a burner unit is provided. The burner unit may be used in a premixed gas heating system. For example, the burner unit may be used in the heating system and in the combustion cell according to one or more aspects of the invention.

The burner unit comprises a burner. The burner unit also comprises a distributor. The distributor and the burner of the burner unit are according to one or more aspects of the invention.

According to an aspect of the invention, a method is provided for using a premixed gas heating system which is able to modulate between a minimum and a maximum load. According to an example, the ratio between the maximum load and the minimum load is at least 4. The method comprises a step of providing a fan unit configured to supply a flow of premixed air-gas necessary for the combustion. The method comprises a step of supplying a flow of premixed air and fuel gas to the burner. Preferably, the fuel gas of said flow of premixed air-gas contains at least 20% by volume of hydrogen. The method comprises a step of providing a burner comprising a plurality of holes. The plurality of holes provides a useful transit area defined as an area which allows the outflow of the flow of premixed air-gas from an area upstream of the burner to an area in which combustion flames are generated. According to an example, the method comprises a step of providing a load controller. The load controller is configured to adjust an outlet load of the heating system in such a way that the heating system modulates between the minimum load and the maximum load. The method may comprise a step of setting up a minimum load value such that a combustion index value is between 4 E06 and 6 E07. The combustion index is defined as the ratio between the minimum load and the useful transit area of the burner. The method may also comprise a step of providing the burner with a first group of holes and a second group of holes. Preferably, the second group of holes has a diameter at least 30% greater than the first group of holes. According to an example, an area covered by the second group of holes is less than 40% of the total useful transit area of the burner. The method may comprise a step of providing the burner with a peripheral zone free of holes. The method may comprise a step of providing a distributor comprising a peripheral part. The peripheral part of the distributor has a plurality of apertures. The distributor also has a central part having a plurality of holes. Preferably, the apertures of the peripheral part constitute at least 60% of the total area of the holes of the distributor.

The method may comprise a step of locating the distributor upstream of the burner for feeding the premixed flow of air-gas to the burner. The distributor is positioned in such a way that the peripheral part of the distributor faces towards the peripheral zone of the burner. This configuration makes it possible to have a better circulation between the burner and the distributor which leads to the cooling of the burner.

The method may comprise a step of providing a plurality of operating modes to a user. Each operating mode of the plurality of operating modes corresponds to a respective range of the plurality of reference ranges for the combustion index.

The method comprises a step of selecting a reference range for the combustion index, between a plurality of reference ranges for the value of the combustion index, as a function of the operating mode selected by the user. The method comprises a step of setting the minimum load to a value within the selected reference range.

According to an aspect of the invention, a method is provided for making a premixed gas heating system which is able to modulate between a minimum and a maximum load. According to an example, the ratio between the maximum load and the minimum load is at least 4. The method comprises a step of providing a fan unit configured to provide a flow of premixed air-gas necessary for the combustion. According to an example, the method comprises a step of providing a flow of premixed air and fuel gas to the burner, wherein the fuel gas of said flow of premixed air-gas contains at least 20% by volume of hydrogen. The method comprises a step of providing a burner comprising a plurality of holes. The plurality of holes provides a useful transit area defined as an area which allows the outflow of the flow of premixed air-gas from an area upstream of the burner to an area in which combustion flames are generated.

The method may comprise a step of providing a load controller. The load controller is configured to adjust an outlet load of the heating system in such a way that the heating system modulates between the minimum load and the maximum load. The minimum load is set to a predetermined reference value. According to an example, the useful transit area provided by the burner is such that a combustion index value is between 4 E06 and 6 E07. The combustion index is defined as the ratio between the reference value of the minimum load and the useful transit area of the burner.

BRIEF DESCRIPTION OF DRAWINGS

These and other features of the invention will become more apparent from the following detailed description of a preferred, non-limiting example of it, with reference to the accompanying drawings, in which.

DETAILED DESCRIPTION OF PREFERRED EMBODIMENTS OF THE INVENTION

Figure 1:
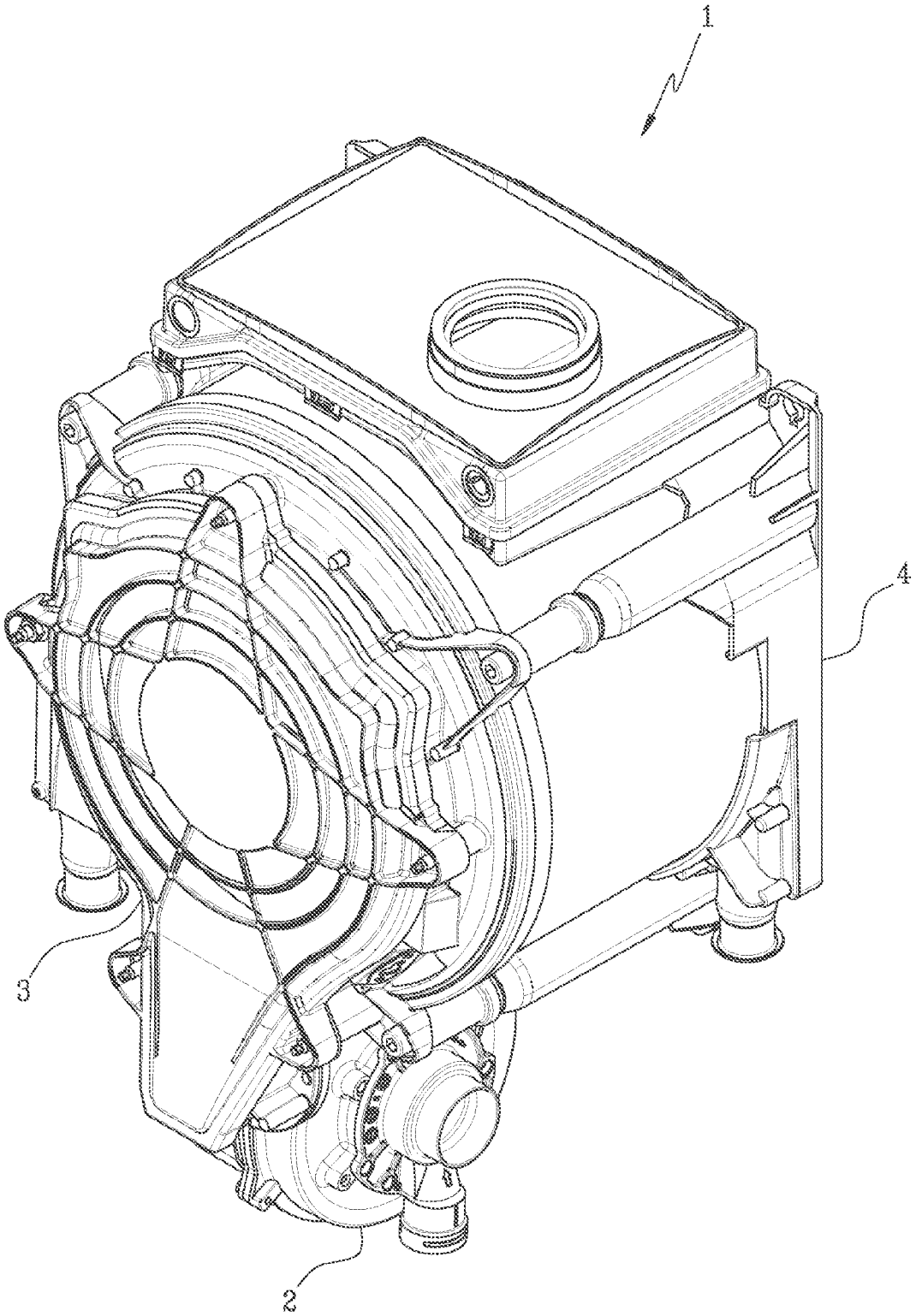
FIG. 1 illustrates a combustion cell according to the invention.
Figure 2:
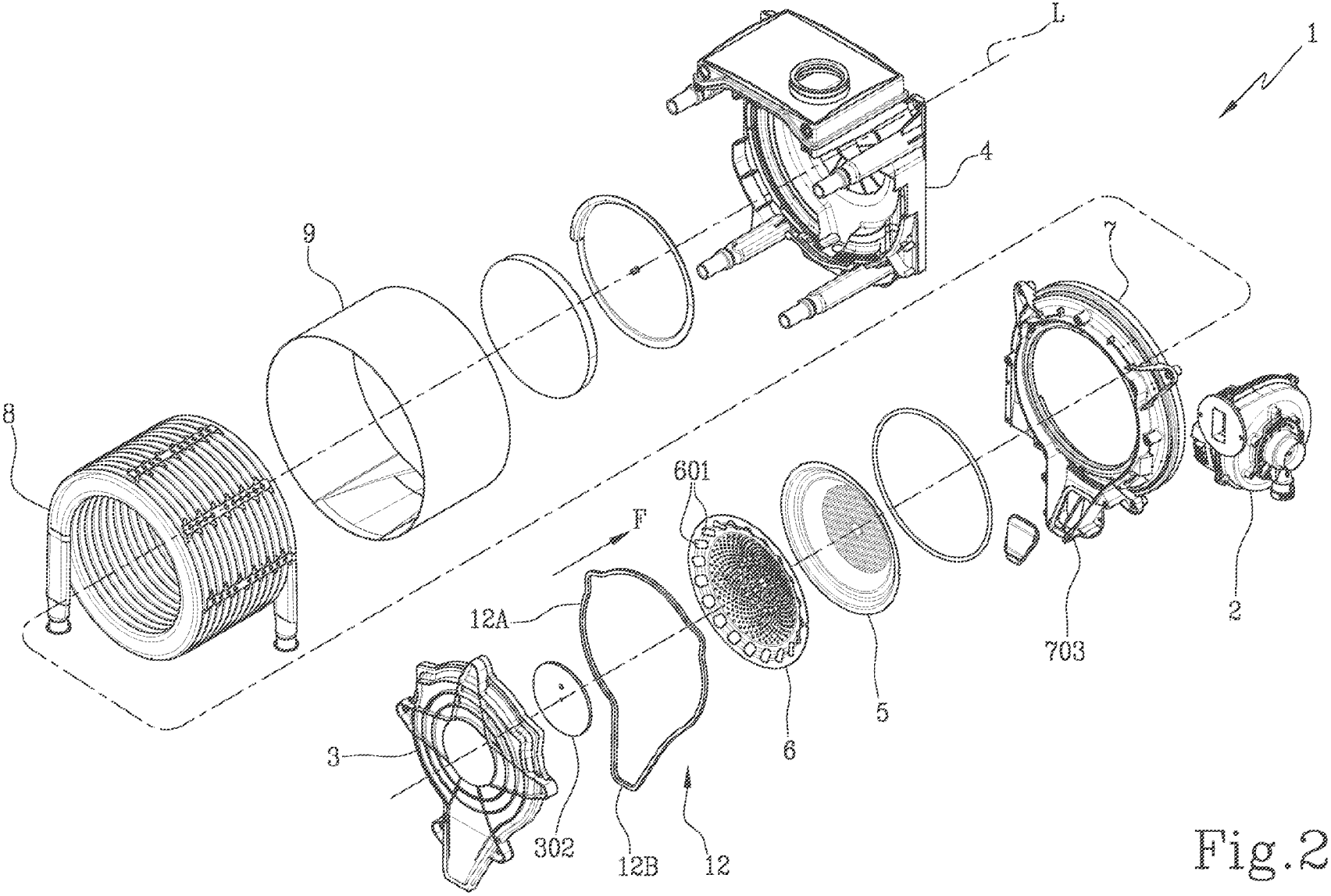
FIG. 2 is an exploded perspective view of the combustion cell of FIG. 1.
Figure 3:
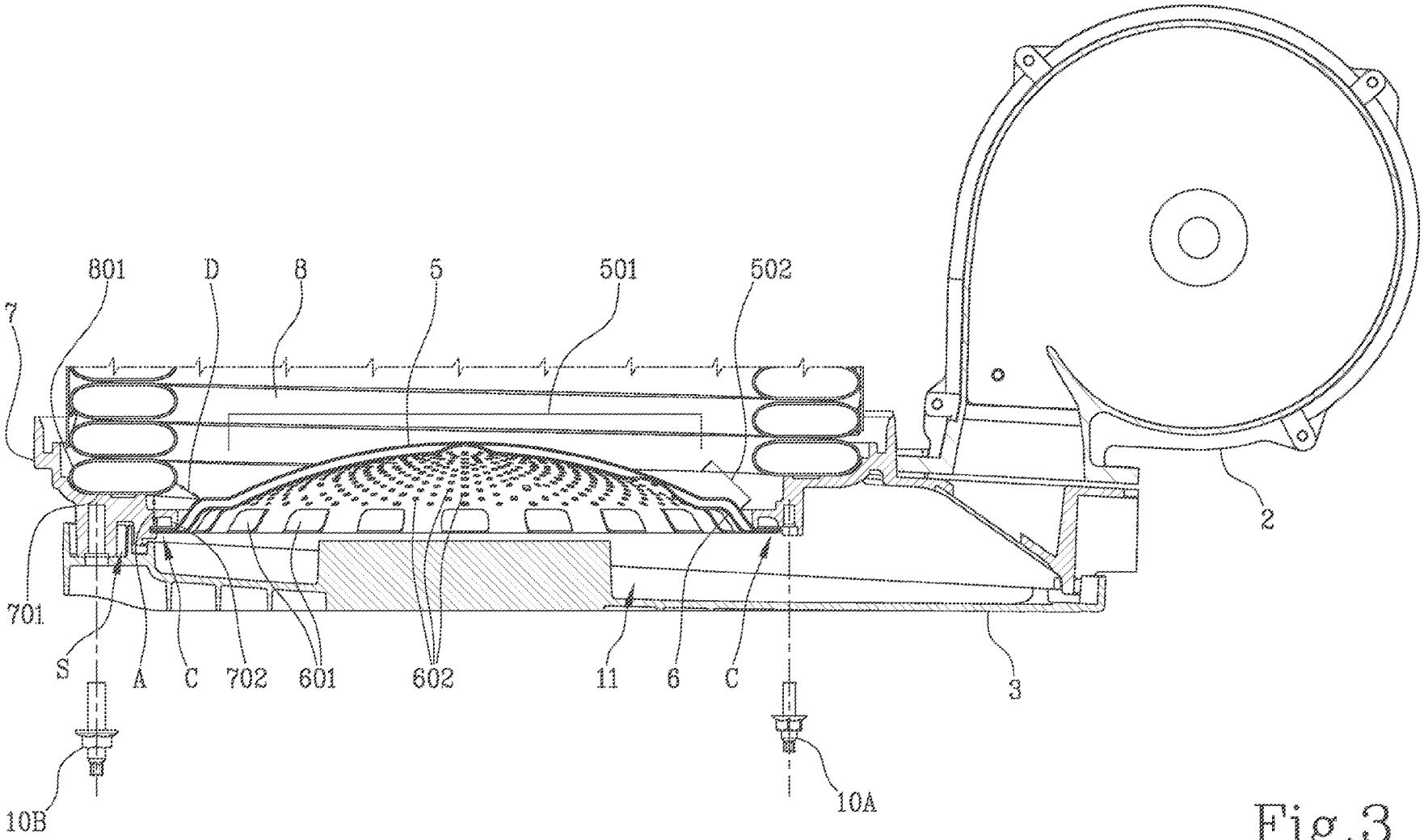
FIG. 3 is a cross section of a burner unit, formed by the burner and the distributor.
Figure 4B:
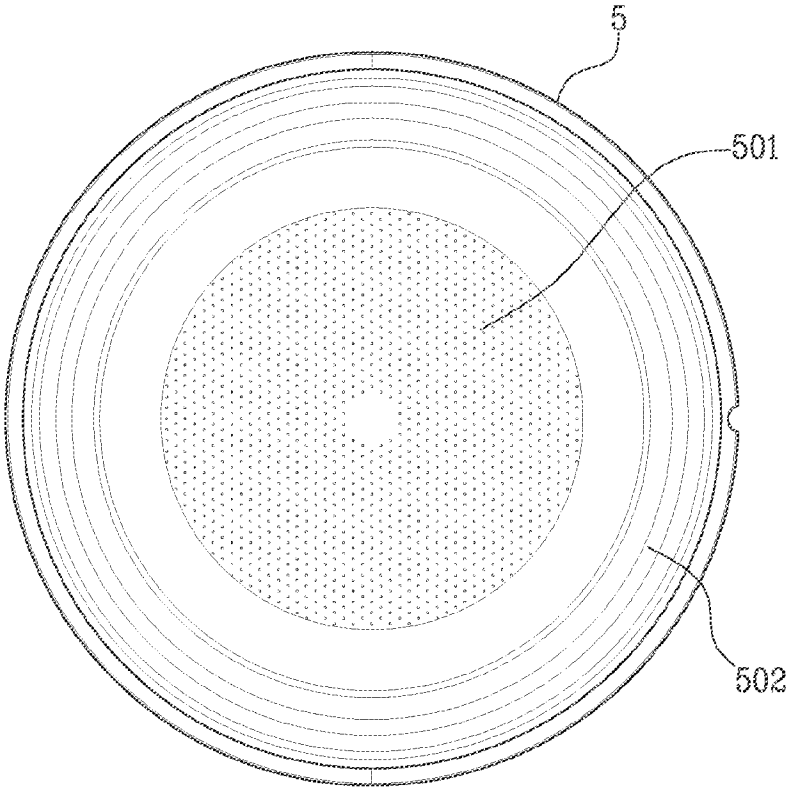
FIGS. 4A and 4B are front views of the burner unit (distributer and burner, respectively)
Figure 4A:
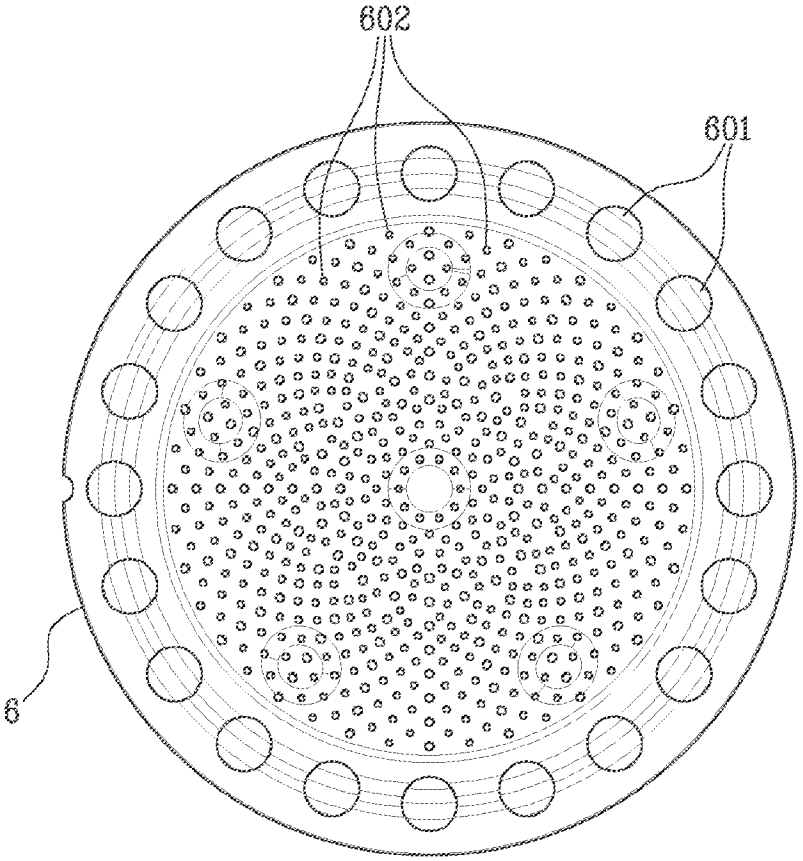
Figure 5:
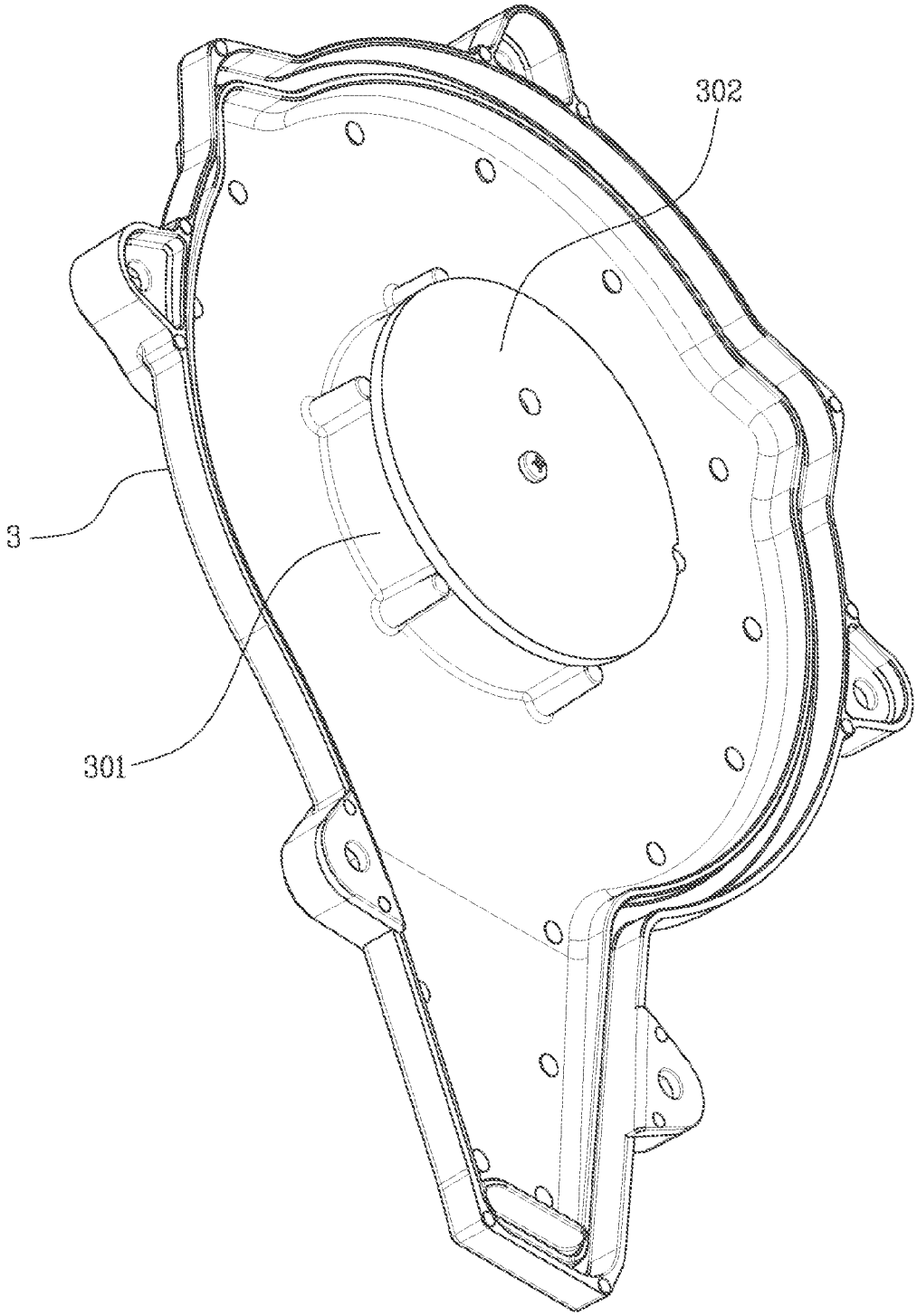
FIG. 5 is a front view of the lid of the combustion cell.
Figure 6:
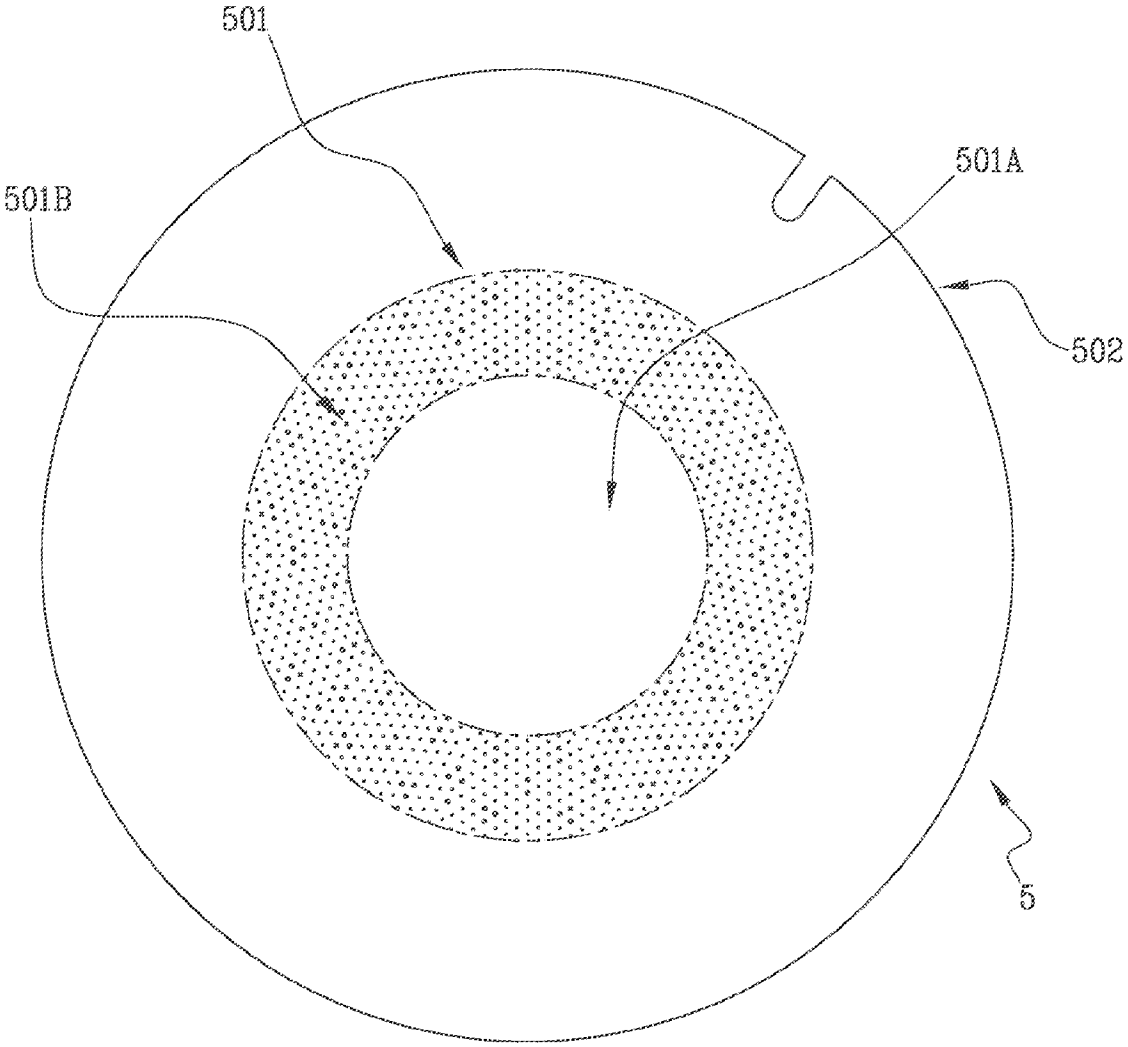
FIG. 6 is a front view of the inner part and the outer part of the central zone of the burner.
Figure 7:
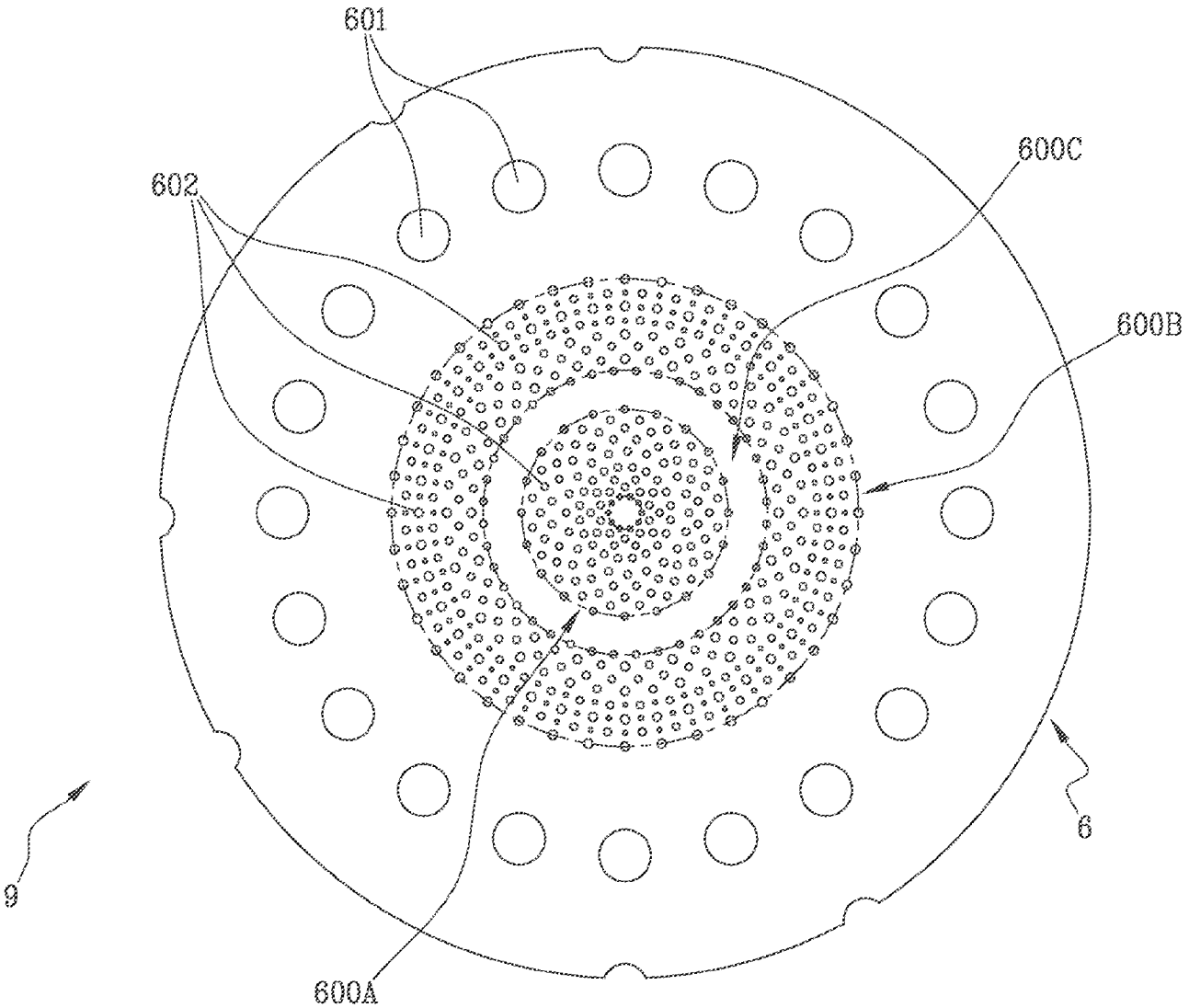
FIG. 7 is a front view of the distributor.
Figure 8:
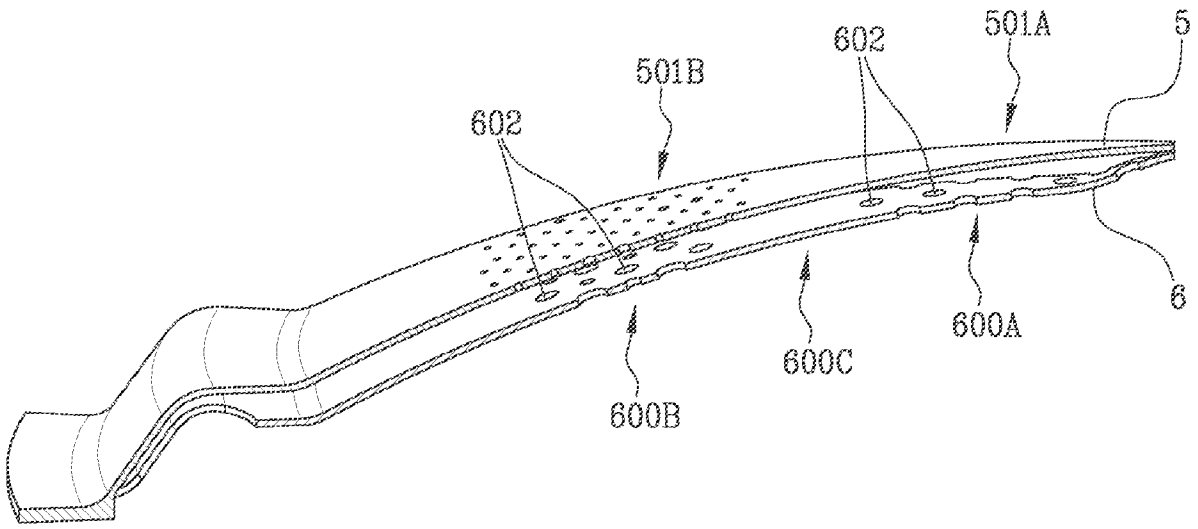
FIGS. 8 and 9 are cross sections of the burner unit and distributor.
Figure 9:
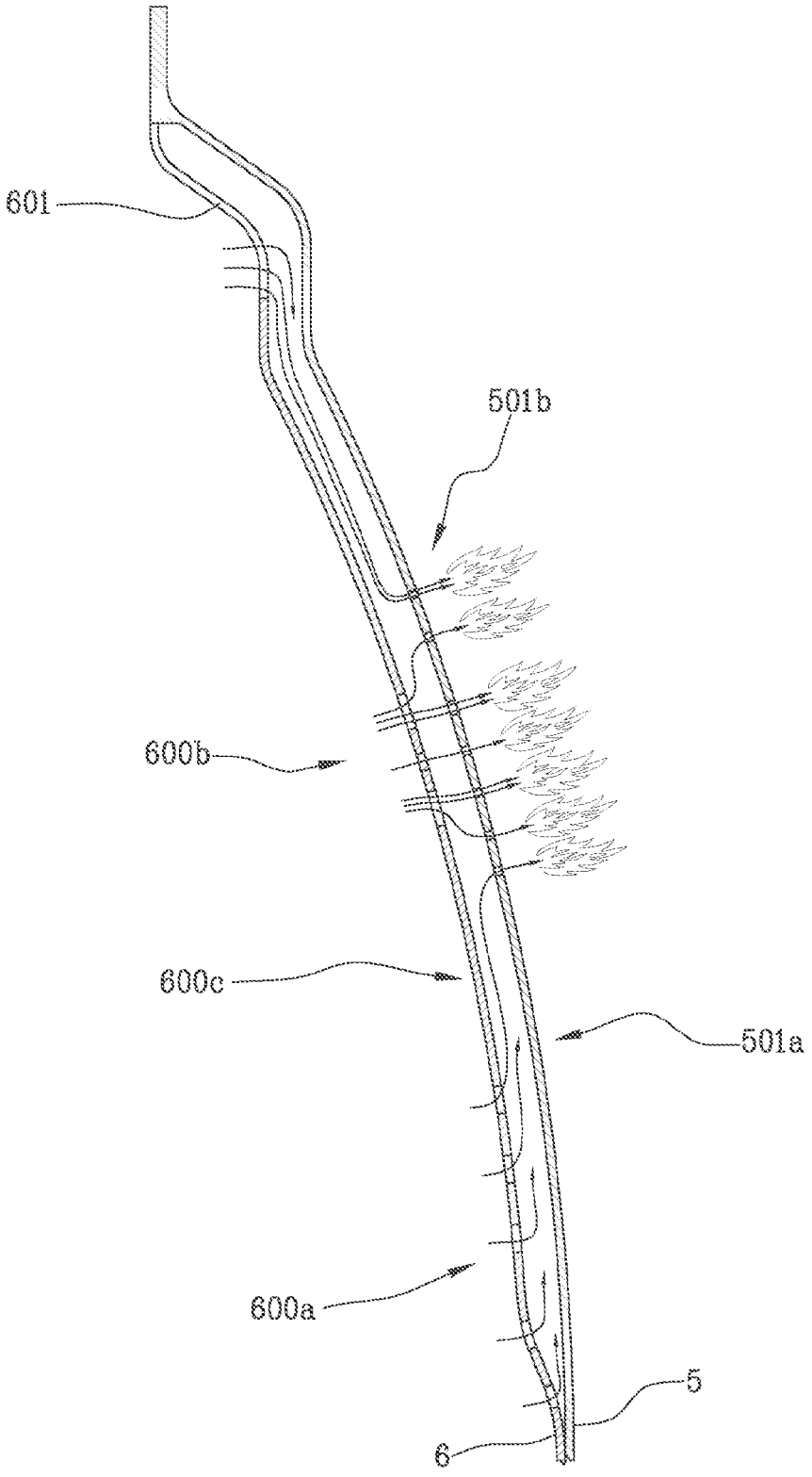

With reference to the accompanying drawings, the numeral 1 denotes a combustion cell for a boiler. The combustion cell (that is to say, the cell) 1 comprises a fan unit 2. The fan unit 2 is configured to supply a flow of premixed air-gas required for the combustion. The cell 1 comprises a combustion chamber. The combustion chamber extends along a longitudinal axis L from a first end to a second end. The cell 1 comprises a lid 3. The lid 3 is configured for closing the first end of the combustion chamber. The cell includes a bottom element 4. The cell 1 is closed at its first end by the lid 3 and at its second end by the base element 4. The cell 1 comprises a burner 5. According to an example of the burner 5 has a convex shape. The burner may comprise a central zone 501 and a peripheral zone 502. The central zone 501 is perforated whilst the peripheral zone 502 is free of holes. The cell 1 also comprises a distributor 6. Preferably, the distributor 6 is convex in shape. The distributor 6 comprises a peripheral part provided with apertures 601. The distributor may also comprise a central part including a plurality of holes. According to an example, the central holes 602 of the plurality of holes of the central part of the distributor are smaller than the apertures 601 of the peripheral part of the distributor 6. According to an example, the apertures 601 of the peripheral part form at least 60% of the total surface of the holes of the distributor 6. The distributor 6 is positioned upstream of the burner 5 for feeding the flow of premixed air-gas to the burner 5.

The distributor 6 is positioned in such a way that the peripheral part of the distributor 6 faces towards the peripheral zone 502 of the burner 5. In this way, the flow of premixed air-gas enters into the apertures 601 of the peripheral part of the distributor 6 and comes into contact with the peripheral zone 502 of the burner 5; before the flow of air-gas passes through the central zone 501 of the burner 5, a circulation of the air-gas flow is generated between the peripheral zone of the burner 5 and the peripheral part of the distributor 6 which cools the burner 5. According to an example, the apertures 601 of the peripheral part of the distributor 6 form at least 60% of the total surface of the holes of the distributor 6. The cell 1 may comprise a flange 7. The flange 7 is configured to connect the lid 3 to the burner 5.

The cell 1 comprises a coil 8 for exchanging heat. The coil 8 is arranged around the longitudinal axis L to surround the combustion chamber. The coil 8 is provided with a plurality of spirals, including a first spiral 801 proximal to the burner 5 and a last spiral distal to the burner 5. The cell 1 also comprises an outer jacket 9 configured to house the coil 8. Preferably, the flange 7 has an internal diameter equal to or greater than the internal diameter of the coil 8. The flange 7 provides a receiving surface, which receives the first spiral 801 of the coil 8 to exchange heat in direct contact with it.

According to an example, an absolute distance D between the coil 8 to exchange heat and the burner 5 varies with respect to the angular position around the longitudinal axis L. The absolute distance D varies between a minimum value and a maximum value. According to an example, the minimum value of the minimum absolute distance D is less than 15 mm. Preferably, the minimum value of the absolute minimum distance D is less than 8 mm. The maximum value of the minimum absolute distance D is less than 25 mm. Preferably, the maximum value of the absolute minimum distance D is less than 18 mm. According to an example, a minimum axial distance A between the coil 8 to exchange heat and the burner 5 along the longitudinal axis L varies between a minimum value and a maximum value. According to an example, the minimum value of the minimum axial distance A is less than 20 mm. Preferably, the minimum value of the minimum axial distance A is less than 12 mm. According to an example, the maximum value of the minimum axial distance A is less than 30 mm. Preferably, the maximum value of the minimum axial distance A is less than 22 mm. The burner 5 and the distributor form a burner unit. According to an example, the burner unit is fixed to the flange by one or more screws 10° in a first connecting zone C. Preferably, the flange 7 has a part in the shape of a tooth 702 at the first connecting zone C. This solution makes it possible to directly connect a minimum portion of flange 7 to the burner unit and to prevent overheating of the flange 7. According to an example, the lid 3 is fixed to the flange 7 in a second connecting zone S. Preferably, the lid 3 is fixed to the flange 7 by a plurality of axial screws 10B. According to an example, the second connecting zone S is distinct and spaced from the first connecting zone C. The cell 1 also comprises a feeding chamber 11. The feeding chamber 11 is defined between the lid 3 and the distributor. The flange 7 includes an ear 701. The ear 701 extends radially with respect to the longitudinal axis L. The ear 701 is configured to receive the fan unit 2. The cell 1 comprises a feeding duct for feeding the flow of premixed air-gas supplied from the fan unit 2 to the feeding chamber 11. According to an example, the ear 701 of the flange acts in conjunction with the lid 3 to delimit the feeding duct. The feeding duct has an inlet situated in an outlet of the fan unit and an outlet open to the feeding chamber. According to an example, the flow of premixed air-gas flows in said combustion chamber 11 in a forwards direction F from the first end to the second end of the combustion chamber 11. Preferably, the flow of premixed air-gas inside the feeding duct, at the inlet of the feeding duct is oriented in an inlet direction having at least one component directed longitudinally in a backwards direction, opposite the forward direction F. Moreover, preferably, the flow of premixed air-gas inside the feeding duct, at the outlet of the feeding duct, is oriented in an outlet direction having at least one component directed radially towards the longitudinal axis L.

The lid 3 includes an inner surface which delimits the combustion chamber 11. According to an example, the lid 3 includes a projection in a central zone of the inner surface. The protrusion protrudes in the feeding chamber 11 and forms a shaped annular portion 301. According to an example, the annular portion 301 has a lid 302. The lid includes a hole. According to a preferred example, the annular portion 301 acts in conjunction with the apertures 601 provided in the peripheral part of the distributor 6 to provide a manifold for dispensing to the apertures 601 of the peripheral part of the distributor 6 the premixed air-gas supplied by the fan unit 2.

The cell 1 may also comprise a gasket 12 for sealing the lid 2. The gasket 12 is positioned between the lid 3 and the flange 7. According to an example, the gasket 12 for sealing the lid 2 has a first portion 12 A and a second portion 12B. The first portion 12A is annular and is positioned around the longitudinal axis L. The second portion 12B is offset with respect to the longitudinal axis L, in contact with the ear 701 of the flange.

According to an aspect of the invention, a method for heating water in a heating system is also provided. The method comprises a step of providing a fan unit 2 to provide a flow of premixed air-gas necessary for the combustion. The method comprises a step of providing a lid 3. The method comprises a step of providing a burner 5. The burner is preferably convex in shape. The method comprises a step of providing a distributor 6. The distributor is preferably convex in shape. The method also comprises a step of providing a coil 8 for exchanging heat. According to an example, the coil 8 for exchanging heat extends around a longitudinal axis L to surround a combustion chamber. The coil 8 has a plurality of spirals comprising a first spiral 801 proximal to the burner and a last spiral distal to the burner 5. The method comprises a step of providing a lid 3. The lid 3 is configured to close a first end of the combustion chamber. The method may comprise a step of providing the burner 5 with a central perforated zone 501 and a peripheral zone 502 without holes. The method may comprise a step of providing the distributor 6 with a peripheral part provided with apertures 601. The distributor is located upstream of the burner 5, in such a way that the peripheral part of the distributor 6 faces the peripheral zone 502 of the burner 5.

The method may comprise a step of providing a flange 7. According to an example, the flange 7 is connected to the lid 3 and to the burner 5. According to an example, the flange 7 has a receiving surface 701 and receives the first spiral 801 of the coil 8 to exchange heat in direct contact with it. The method comprises a step of circulating water in the coil 8 for exchanging heat. The method comprises a step of providing a mixture of fuel gas and air to the burner 5, through the distributor 6. According to an example, the fuel gas of the mixture of gas and air is natural gas.

The method may comprise a step wherein a burner unit formed by the burner 6 and by the distributor 5 is directly fixed to the flange 7. According to an example, the burner unit is fixed to the flange 7 in a first connecting zone C and the lid 8 is fixed to the flange 7 in a second connecting zone S. The second connecting zone S is distinct and spaced from the first connecting zone C. According to an example, the fan unit 2 is connected to the flange 7; consequently, it is possible to access said burner unit formed by the burner 5 and by the distributor 6, removing the lid 3, without removing the fan unit 2. The method may comprise a step of providing a feeding chamber 11 between the lid 3 and the distributor 6. The method may comprise a step of conveying the flow of premixed air-gas by the fan unit 2 to the feeding chamber 11, through a duct delimited by the flange 7 and by the lid 3. Preferably, the premixed air-gas flow is conveyed to the feeding chamber 11 with an orientation having a radial component directed towards the longitudinal axis L, so as to generate within the feeding chamber 11 an air-gas flow touching an inner surface of the lid 3.

According to an aspect of the invention, a premixed gas heating system is also provided. The heating system may comprise a combustion cell according to one or more aspects of the invention irrespective of the fuel used. The heating system comprises a fan unit 2. The fan unit 2 is configured to supply a flow of premixed air-gas required for the combustion. According to an example, a fuel gas of the flow of premixed air-gas contains at least 20% by volume of hydrogen. Preferably, the fuel gas of the flow of premixed air-gas supplied to the burner contains at least 60% by volume of hydrogen. More preferably, the fuel gas of the flow of premixed air-gas supplied to the burner is 100% hydrogen. Alternatively, the heating system may use a mixture of air and natural gas. The heating system comprises a burner 5. The burner 5 has a plurality of holes. The plurality of holes provides a useful transit area defined as an area which allows the outflow of the flow of premixed air-gas from a feeding chamber 11 upstream of the burner 5 to a combustion chamber where combustion flames are generated. The heating system may comprise a load controller. The load controller is configured for adjusting an outlet load of the heating system in such a way that the heating system modulates between a minimum load and a maximum load. According to an example, the ratio between the maximum load and the minimum load is at least 4. Preferably, the ratio between the minimum load and the maximum load is equal to 8.

According to an example, the minimum load of the heating system is set in such a way that a combustion index is between 4 E06 and 6 E07. The combustion index is defined as the ratio between the minimum load and the useful transit area of the burner. The heating system may have different ranges for the value of the combustion index. An optimum range (that is to say, High Range) comprises the combustion index between 6 E07 and 2 E07. In this range the heating system has a high efficiency and a low modulation amplitude. The heating system may have a range for the combustion index of between 8 E06 and 2 E07. This range is a Balanced Range where there is an equilibrium between the efficiency of the heating system and its modulation amplitude.

The combustion index of the heating system may be in a third range (that is to say, Low Range) of between 4 E06 and 8 E06. In this range the heating system has a greater modulation amplitude and an efficiency less than the other two ranges. According to an example, the plurality of holes of the burner 5 includes a first group of holes and a second group of holes. The first group of holes has a first diameter. The second group of holes has a second diameter. According to an example, the first diameter is smaller than the second diameter.

According to an example, the second diameter is increased by at least 30% with respect to the first diameter. Preferably, an area covered by the second group of holes is less than 40% of the total useful transit area of the burner 5. The burner 5 of the heating system may comprise a central zone 501 and a peripheral zone 502. According to an example, the central zone 501 is perforated whilst the peripheral zone 502 is free of holes, the heating system also comprises a distributor 6. The distributor 6 has a peripheral part provided with apertures 601. The distributor 6 is located upstream of the burner for feeding the flow of premixed air-gas to the burner 5. Preferably, the distributor 6 is positioned in such a way that the peripheral part of the distributor 6 faces towards the peripheral zone 502 of the burner 5.

The distributor 6 may include a plurality of holes in its central part. The holes in the central part of the distributor are different in size from those of the peripheral part. According to an example, the apertures 601 of the peripheral part form at least 60% of the total area of the holes of the distributor 6. According to an example, the burner 5 has a convex shape. Alternatively, the burner 5 may have a cylindrical shape.

According to an example, the central zone 501 of the burner 5 includes an inner part 501A and an outer part 501B. According to an example, the inner part 501A of the central zone 501 of the burner 5 is free of holes. Moreover, according to an example, the outer part 501B of the central zone of the burner is perforated. The outer part 501B of the central zone of the burner may be an annular zone which surrounds the inner part 501A of the central zone of the burner. Moreover, the inner part of the burner faces a perforated zone of the distributor.

Moreover, according to an example, the central part of the distributor includes a central inner part 600A and a central outer part 600B. According to an example, the central inner part 600A and the central outer part 600B are both perforated and may be separated by a zone free of holes 6000. The zone of the distributor 6 without holes 6000 may be an annular zone. According to an example, the central outer part 600B of the distributor faces the outer part 501B of the central zone of the burner, where there are the holes and, consequently, the flames. Moreover, the central inner part 600A of the distributor 6 faces the inner part 501A of the central zone of the burner 5.

Moreover, according to an example, the outer part 501B of the central zone 501 of the burner is more extended than the central outer part 600B of the distributor. In other words, the useful transit area of the burner is larger than that of the distributor.

According to an example, the load controller has access to a memory. The memory contains a plurality of reference ranges for the value of the combustion index. Moreover, the load controller is programmed to provide a user with a plurality of operating modes, wherein each operating mode of the plurality of operating modes corresponds to a respective reference range corresponding to the operating mode selected by the user.

According to an aspect of the invention, a method is provided for operating a premixed gas heating system which is able to modulate between a minimum and a maximum load. The heating system may comprise a combustion cell according to one or more aspects of the invention. According to an example, the ratio between the maximum load and the minimum load is at least 4. According to another example, the ratio between the maximum load and the minimum load is equal to 8. The method comprises a step of providing a fan unit 2 configured to provide a flow of premixed air-gas necessary for the combustion. The method comprises a step of providing a flow of premixed air and fuel gas to the burner. According to an example, the fuel gas of said flow of premixed air-gas contains at least 20% by volume of hydrogen. The method comprises a step of providing a burner 5. The burner 5 comprises a plurality of holes on a central part 501 of the burner 5. The plurality of holes provides a useful transit area defined as an area which allows the outflow of the flow of premixed air-gas from an area upstream of the burner 5 to an area in which combustion flames are generated. The method may comprise a step of providing the burner 5 with a first group of holes and a second group of holes. According to an example, the second group of holes has a diameter at least 30% greater than the first group of holes. Preferably, an area covered by the second group of holes is less than 40% of the total useful transit area of the burner. The method may comprise a step of providing a load controller. The load controller is configured to adjust an outlet load of the heating system in such a way that the heating system modulates between the minimum load and the maximum load. The method may comprise a step of setting up a minimum load value such that a combustion index value is between 4 E06 and 6 E07. The combustion index is defined as the ratio between the minimum load and the useful transit area of the burner.

The method may also comprise a step of providing the burner 5 with a peripheral zone 502 free of holes. The method comprises a step of providing a distributor 6. The distributor comprises a peripheral part having apertures 601. The distributor has a central part having a plurality of holes. According to an example, the apertures 601 of the peripheral part constitute at least 60% of the total area of the holes of the distributor 6. Preferably, the method comprises a step of positioning the distributor 6 upstream of the burner 5 for feeding the premixed air-gas flow to the burner 5 and in such a way that the peripheral part of the distributor 6 faces towards the peripheral zone 502 of the burner 5.

The method may comprise a step of providing a plurality of operating modes to a user. Each operating mode of the plurality of operating modes corresponds to a respective range of the plurality of reference ranges. Each reference range includes a plurality of values for the combustion index. The method may comprise a step of selecting three ranges for the value of the combustion index: "optimum, balanced, low". The optimum range allows a high efficiency and a low modulation amplitude to be achieved. The balanced range does not allow either high efficiency or an extremely large modulation amplitude. The low range allows the modulation amplitude to be increased as much as possible.

The method comprises a step of selecting a reference range for the combustion index, between a plurality of reference ranges for the value of the combustion index, as a function of the operating mode selected by the user. The method comprises a step of setting the minimum load to a value within the selected reference range.

According to an aspect of the invention, a method is provided for making a premixed gas heating system which is able to modulate between a minimum and a maximum load. The heating system may comprise a combustion cell according to one or more aspects of the invention irrespective of the fuel used. According to an example, the ratio between the maximum load and the minimum load is at least 4. The method comprises a step of providing a fan unit 2. The fan unit 2 is configured to supply a flow of premixed air-gas necessary for the combustion. The method comprises a step of providing a flow of premixed air and fuel gas to the burner. According to an example, the fuel gas of said flow of premixed air-gas contains at least 20% by volume of hydrogen. Alternatively, the fuel gas could be a flow of natural gas. The method may comprise a step of providing a burner 5. The burner 5 comprises a plurality of holes. The plurality of holes provides a useful transit area defined as an area which allows the outflow of the flow of premixed air-gas from an area upstream of the burner 5 to an area in which combustion flames are generated. The method may comprise a step of providing the burner with a peripheral zone 502 free of holes. The method may comprise a step of providing a distributor 6. The distributor has a central zone comprising the holes. The distributor 6 includes a plurality of apertures 601 in a peripheral part of it. According to an example, the method comprises a step of positioning the distributor upstream of the burner 5 for feeding the premixed air-gas flow to the burner 5 and in such a way that the peripheral part of the distributor is facing towards the peripheral zone 502 of the burner. The method may comprise a step of providing a load controller. The load controller is configured to adjust an outlet load of the heating system in such a way that the heating system modulates between the minimum load and the maximum load. The minimum load is set to a predetermined reference value. The useful transit area provided by the burner 5 is such that a combustion index value is between 4 E06 and 6 E07. The combustion index being defined as the ratio between the reference value of the minimum load and the useful transit area of the burner.

The following paragraphs, listed with alphanumeric references, represent exemplary and non-limiting ways of describing the present invention.

A. A combustion cell (1) for a heating system, the combustion cell (1) comprising:
- a fan assembly (2) configured to supply a premixed air-gas flow required for combustion;
- a combustion chamber extending along a longitudinal axis (L) from a first end to a second end;
- a lid (3), for closing the first end of the combustion chamber;
- a burner (5);
- a flange (7), configured for connecting the cover (3) to the burner (5);
- a heat exchanger coil (8), arranged around the longitudinal axis (L) to surround the combustion chamber and provided with a plurality of wraps including a first wrap (801) proximal to the burner (5) and a last wrap distal to the burner.

A1. The heat exchanger cell (1) according to paragraph A, wherein the burner (5) has a convex or flat profile.

A1.1. The combustion cell (1), according to paragraph A1, wherein the burner (5) includes a central region (501) and a peripheral region (502), wherein the central region (501) is perforated whilst the peripheral region (502) is hole-free.

A1.2. The combustion cell (1) according to any of paragraphs A1 to A1.1, wherein a plurality of holes of the burner (5) includes a first group of holes having a first diameter and a second group of holes having a second diameter, the first diameter being smaller than the second diameter.

A1.2.1. The combustion cell (1) according to paragraph A1.2, wherein the second diameter is increased by at least 30% with respect to the first diameter.

A1.2.2. The combustion cell (1) according to paragraph A1.2 or A1.2.1, wherein an area covered by the second group of holes is less than 40% of the total free passage area of the burner.

A2. The combustion cell (1) according to any of paragraphs A to A1.2.2, comprising a distributor (6), located upstream of the burner (5) to feed the premixed air-gas flow to the burner (5)

A2.1. The combustion cell (1) according to paragraph A2, wherein the distributor (6) has a convex or flat profile.

A2.2. The combustion cell (1) according to any of paragraphs A2 to A2.1, wherein the distributor (6) includes a peripheral region provided with apertures (601) and is arranged so that the peripheral region of the distributor (6) is facing the peripheral region (502) of the burner (5).

A2.3. The combustion cell (1) according to any of paragraphs A2 to A2.2, wherein the distributor (6) includes a plurality of holes on its central region, having different dimensions from those of the peripheral region, and wherein the apertures (601) of the peripheral region form at least 60% of the total area of the holes of the distributor (601).

A3. The combustion cell (1) according to any of paragraphs A to A2.3, in which the flange (7) has a receiving surface (701), which accommodates the first wrap (801) of the heat exchanger coil (8) in direct contact thereto.

A4. The combustion cell (1) according to any of paragraphs A to A3, wherein a minimum overall distance (D) between the heat exchanger coil (8) and the burner (5) varies with respect to the angular position around the longitudinal axis (L), between a minimum value and a maximum value, and wherein at least one the of the following conditions is met:

i) the minimum value of the minimum overall distance (D) is less than 15 mm;

ii) the maximum value of the minimum overall distance (D) is less than 25 mm.

A4.1. The combustion cell (1) according to paragraph A4, wherein at least one the of the following conditions is met:

i) the minimum value of the minimum overall distance (D) is less than 8 mm;

ii) the maximum value of the minimum overall distance (D) is less than 18 mm.

A5. The combustion cell (1) according to any of paragraphs A to A4.1, wherein a minimum axial distance (A) between the heat exchanger coil (8) and the burner (5) along the longitudinal axis (L) varies, between a minimum value and a maximum value, and wherein at least one the of the following conditions is met:

i) the minimum value of the minimum axial distance (A) is less than 20 mm;

ii) the maximum value of the minimum axial distance (A) is less than 30 mm.

A5.1. The combustion cell (1) according to paragraph A5, wherein, at least one the of the following conditions is met:

i) the minimum value of the minimum axial distance (A) is less than 12 mm;

ii) the maximum value of the minimum axial distance (A) is less than 22 mm.

A6. The combustion cell (1) according to any of paragraphs A to A5.1, wherein a burner assembly formed by the burner (5) and the distributor (6) is attached to the flange (7) through one or more connecting elements at a first connecting zone (C).

A6.1. The combustion cell (1) according to paragraph A6, wherein the lid (3) is attached to the flange (7) at a second connecting zone (S), the second connecting zone being distinct and spaced apart with respect to the first connecting zone.

A7. The combustion cell (1) according to any of paragraphs A to A6.1, further comprising a feeding chamber (11) defined between the lid (3) and the distributor (6), wherein the flange (7) includes an ear (703) extending radially with respect to the longitudinal axis (L), for receiving the fan assembly (2) connected thereto.

A7.1. The combustion cell (1) according to paragraph A7, wherein the ear (703) of the flange (7) cooperates with the lid (3) to delimit a feeding duct configured to feed the premixed air-gas flow supplied by the fan assembly (2) to the feeding chamber.

A7.1.1. The combustion cell (1) according to paragraph A7.1, wherein the air-gas flows in the combustion chamber (11) in a forward direction (F) from the first end to the second end of the combustion chamber, and wherein the feeding duct has an inlet located at an outlet of the fan assembly an outlet open to the feeding chamber, wherein the flow of the premixed air-gas within the feeding duct, at the inlet of the feeding duct is oriented in an inlet direction having at least a component directed longitudinally in a backward direction opposite the forward direction.

A7.1.2. The combustion cell (1) according to paragraph A7.1 or A7.1.1, wherein the flow of the premixed air-gas within the feeding duct, at the outlet of the feeding duct is oriented in an outlet direction having at least a component directed radially towards the longitudinal axis (L).

A8. The combustion cell (1) according to any of paragraphs A to A7.1.2, wherein the lid (3) has an inner surface delimiting the combustion chamber and is provided, at a central area of the inner surface, with a protrusion projecting into the feeding camber, thereby forming an annular shaped portion (301) in the feeding chamber (11).

A8.1. The combustion cell (1) according to paragraph A8, wherein the annular portion (301) cooperates with the apertures (601) provided at the peripheral region of the distributor (6) to provide a manifold for delivering to the apertures of the peripheral region of the distributor the premixed air-gas supplied by the fan assembly (2).

A9. The combustion cell (1) according to any of paragraphs A to A8.1, comprising a lid sealing gasket (12), provided between the lid (3) and the flange (7), wherein the lid sealing gasket (12) has a first portion (12A) and a second portion (12B), wherein the first portion of the lid sealing gasket is ring shaped and is arranged around the longitudinal axis (L) and the second portion (12B) is offset the longitudinal axis, in contact with the ear (703) of the flange (7).

B. A premixed gas heating system, comprising:

a fan assembly (2) configured to supply a premixed air-gas flow required for combustion, wherein a combustible gas of the premix air-gas flow contains at least 20% by volume of hydrogen;

a burner (5) including a plurality of holes, wherein the plurality of holes provides a free passage area defined as an area that allows the outflow of the premixed air-gas flow from a feeding chamber (11) upstream the burner (5) to a combustion chamber where combustion flames are generated;

a load controller, configured to regulate an output load of the heating system such that the heating system modulates between a minimum load and a maximum load, wherein a ratio between the maximum load and the minimum load is at least 4.

B1. The heating system according to paragraph B, wherein the minimum load of the heating system is set such that a combustion index ranges between 4 E06 and 6 E07, the combustion index being defined as the ratio of the minimum load over the free passage area of the burner.

B1.1. The heating system according to paragraph B1, wherein combustion index ranges between 8 E06 and 2 E07.

B2. The heating system according to any of paragraphs B to B1.1, wherein the load controller has access to a memory containing a plurality of reference ranges for the value of the combustion index, is programmed to provide a user with a plurality of operating modes, wherein each operating mode of the plurality of operating modes corresponds to a respective range of the plurality of reference ranges and, is programmed to set the minimum load to a value within the reference range corresponding to the operating mode selected by the user.

B2.1. The heating system according to paragraph B2, wherein the memory contains:

a first reference interval for the combustion index value, between 4 E06 and 8 E06;

a second reference interval for the combustion index value, between 8 E06 and 2 E07;

a third reference interval for the combustion index value, between 2 E07 and 6 E07.

B3. The heating system according to any of paragraphs B to B2.1, ratio between the maximum load and the minimum load is preferably 8.

B4. The heating system according to any of paragraphs B to B3, wherein combustible gas of the premix air-gas flow supplied to the burner contains at least 60% by volume of hydrogen.

B4.1. The heating system according to paragraph B4, wherein combustible gas of the premix air-gas flow supplied to the burner is 100% hydrogen.

B5. The heating system according to any of the paragraphs from B to B4.1, wherein the burner (5) has the features described in one or more of the paragraphs from A1 to A1.2.2.

B6. The heating system according to any of paragraphs from B to B4.1, wherein the burner (5) has a cylindrical or flat profile.

B7. The heating system according to any of paragraphs from B to B6, comprising a distributor (6) located upstream of the burner (5).

B7.1. The heating system according to paragraph B7, wherein the distributor (6) has the features described in one or more of paragraphs A2 to A2.3.

B8. The heating system according to any of paragraphs B to B7.1, wherein the burner (5) comprises a central region (501) and a peripheral region (502), wherein the central region (501) of the burner includes an internal part (501A) and an external part (502B), wherein the internal part is hole-free and the external part of the central region of the burner is perforated, the external part of the central region of the burner being an annular zone that surrounds the internal part of the central region.

B8.1. The heating system according to paragraph B8, further comprising a distributor (6) located upstream of the burner to feed the pre-mixed air-gas flow to the burner, wherein the internal part of the central region of the burner faces a perforated area of the distributor (6).

B8.1.1. The heating system according to paragraph B8.1, wherein the distributor (6) includes:

a peripheral region (preferably annular shaped) provided with apertures;

an external central part (preferably annular shaped, preferably coaxial to and positioned inside the peripheral region) provided with holes;

an internal central part (preferably annular or disc in shaped, preferably coaxial to and positioned inside the external central part) provided with holes, wherein the internal part of the central region of the burner faces the internal central part of the distributor (6), while the perforated area of the burner (external part of the central region of the burner) faces the external central part of the distributor (6).

C. A method for heating water in a heating system, comprising the following steps:

providing a fan assembly (2), and a burner (5);

providing a heat exchanger coil (8), the heat exchanger coil extending around a longitudinal axis (L) to surround a combustion chamber and having a plurality of wraps including a first wrap (801) proximal to the burner (5) and a last wrap distal to the burner providing a lid (3) for closing a first end of the combustion chamber;

providing a flange (7), connected to the lid (3) and to the burner (5);

circulating water in the heat exchanger coil (8);

supplying a premix of combustible gas and air to the burner, through a distributor.

C1. The method according to paragraph C, wherein the flange has a receiving surface (701) and accommodates the first wrap (801) of the heat exchanger coil (8) in direct contact thereto.

C2. The method according to any of paragraphs C to C1, wherein the burner (5) has the features described in one or more of paragraphs A1 to A1.2.2.

C3. The method according to any of paragraphs C to C1, wherein the burner (5) has a cylindrical or flat profile.

C4. The method according to any of paragraphs from C to C3, comprising a step of locating the distributor (6) upstream of the burner (5).

C4.1. The method according to paragraph C4, wherein the distributor (6) has the features described in one or more of paragraphs A2 to A2.3.

C5. The method according to any of paragraphs C to C4.1, a burner assembly formed by the burner (5) and the distributor (6) is directly attached to the flange.

C6. The method according to any of paragraphs C to C5, the fan assembly (2) is connected to the flange (7), so that the burner assembly formed by the burner (5) and the distributor (6) can be accessed by removing the lid, without removing the fan assembly.

C7. The method according to any of paragraphs C to C6, wherein a feeding chamber (11) is provided between the lid and the distributor and wherein a premixed air-gas flow is conveyed from the fan assembly to the feeding chamber, through a feeding duct delimited by the flange and by the lid.

C7.1. The method according to paragraph C7, wherein the premixed air-gas flow is conveyed to the feeding chamber (11) with an orientation having a radial component directed towards the longitudinal axis (L), so as to generate within the feeding chamber an air-gas flow touching an inner surface of the lid.

D. A method for operating a premixed gas heating system capable of modulating between a minimum and a maximum load, wherein the ratio of the maximum load over the minimum load is at least 4, the method comprising the following steps:

providing a fan assembly (2) configured to supply a premixed air-gas flow required for combustion;

supplying a premix of combustible gas and air to the burner, wherein combustible gas of said premixed air-gas flow contains at least 20% by volume of hydrogen;

providing a burner (5) including a plurality of holes, wherein the plurality of holes provides a free passage area defined as an area that allows the outflow of the premixed air-gas flow from an area upstream the burner to an area where combustion flames are generated;

providing a load controller, configured to regulate an output load of the heating system such that the heating system modulates between the minimum load and the maximum load.

D1. The method according to paragraph D, where the minimum load is set to a value of minimum load such that a combustion index value is within the range between 4 E06 and 6 E07, the combustion index being defined as the ratio of the minimum load over the free passage area of the burner.

D2. The method according to any of paragraphs D to D.1, wherein the burner (5) has the features described in one or more of paragraphs A1 to A1.2.2.

D3. The method according to any one of paragraphs D to D.2 wherein the burner (5) has a cylindrical or flat profile.

D4. The method according to any of paragraphs D to D3, comprising a distributor (6) located upstream of the burner (5).

D4.1. The method according to paragraph D4, wherein the distributor (6) has the features described in one or more of paragraphs A2 to A2.3.

D5. The method according to any of paragraphs D to D4.1, further comprising the following steps:

providing a user with a plurality of operating modes, wherein each operating mode of the plurality of operating modes corresponds to a respective range of the plurality of reference ranges;

selecting a reference range for the value of combustion index, from a plurality of reference ranges for the value of the combustion index, responsive to the operating mode selected by the user;

setting the minimum load to a value within the selected reference range.

D5.1. The method according to paragraph D5, wherein there are three operating modes, with three corresponding reference intervals as follows:

a first reference range for the value of combustion index, between 4 E06 and 8 E06;

a second reference range for the value of combustion index, between 8 E06 and 2 E07;

a third reference range for the value of combustion index, between 2 E07 and 6 E07.

E. A method for manufacturing a premixed gas heating system capable of modulating between a minimum and a maximum load, wherein the ratio of the maximum load over the minimum load is at least 4, the method comprising the following steps:

providing a fan assembly (2) configured to supply a premixed air-gas flow required for combustion;

providing a premix of combustible gas and air to the burner, wherein combustible gas of said premixed air-gas flow contains at least 20% by volume of hydrogen;

providing a burner including a plurality of holes, wherein the plurality of holes provides a free passage area defined as an area that allows the outflow of the premixed air-gas flow from an area upstream the burner to an area where combustion flames are generated;

providing a load controller, configured to regulate an output load of the heating system such that the heating system modulates between the minimum load and the maximum load, wherein the minimum load is set to a predetermined reference value.

E1. The method according to paragraph E, the free passage area provided by the burner is such that a combustion index value is within the range between 4 E06 and 6 E07, the combustion index being defined as the ratio of the minimum load reference value over the free passage area of the burner.

E2. The method according to paragraph E or E1, including the features described in one or more of paragraphs D2 to D5.1.

F. A burner assembly, comprising:

a burner (5) including a plurality of holes, wherein the plurality of holes provides a free passage area defined as an area that allows the outflow of the premixed air-gas flow from a feeding chamber (11) upstream the burner (5) to a combustion chamber where combustion flames are generated;

a distributor (6) located upstream of the burner (5) to feed the premixed air-gas flow to the burner (5).

F1. The burner assembly according to paragraph F, wherein the burner has the features of one or more of the following paragraphs: from A1 to A1.2.2 and B8.

F2. The burner assembly according to paragraph F or F1, wherein the distributor has the features of one or more of the following paragraphs: from A2.1 to A2.3 and from B8.1 to B8.1.1.

The invention claimed is:

1. A premixed gas heating system, comprising:

a fan assembly configured to supply a premixed air-gas flow required for combustion, wherein a combustible gas of the premix air-gas flow contains at least 20% by volume of hydrogen;

a burner including a plurality of holes, wherein the plurality of holes provides a free passage area defined as an area that allows the outflow of the premixed air-gas flow from a feeding chamber upstream the burner to a combustion chamber where combustion flames are generated; and a load controller, configured to regulate an output load of the burner such that the heating system modulates between a minimum load and a maximum load, wherein a ratio between the maximum load and the minimum load is at least 4, wherein the minimum load of the heating system is set such that a combustion index ranges between 4 E06 and 6 E07, the combustion index being defined as the ratio of the minimum load over the free passage area of the burner, and wherein the load controller has access to a memory containing a plurality of reference ranges for the value of the combustion index, is programmed to provide a user with a plurality of operating modes, wherein each operating mode of the plurality of operating modes corresponds to a respective range of the plurality of reference ranges, and is programmed to set the minimum load to a value within the reference range corresponding to the operating mode selected by the user.

2. The heating system according to claim 1 wherein combustion index ranges between 8 E06 and 2 E07.

3. The heating system according to claim 1, wherein the plurality of holes of the burner includes a first group of holes having a first diameter and a second group of holes having a second diameter, the first diameter being smaller than the second diameter.

4. The heating system according to claim 3, wherein the second diameter is increased by at least 30% with respect to the first diameter.

5. The heating system according to claim 3, wherein an area covered by the second group of holes is less than 40% of the total free passage area of the burner.

6. The heating system according to claim 1, wherein the ratio between the minimum load and the maximum load is at least 8.

7. The heating system according to claim 1, wherein the combustible gas of the premix air-gas flow supplied to the burner contains at least 60% by volume of hydrogen.

8. The heating system according to claim 7, wherein the combustible gas of the premix air-gas flow supplied to the burner is 100% hydrogen.

9. The heating system according to claim 1, wherein the burner includes a central region and a peripheral region, and wherein the central region is perforated whilst the peripheral region is hole-free, further comprising a distributor including a peripheral region provided with apertures, the distributor being located upstream the burner to feed the premixed air-gas to the burner and being arranged so that the peripheral region of the distributor faces the peripheral region of the burner.

10. The heating system according to claim 9 wherein the distributor includes a plurality of holes on its central region, having different dimensions from those of the peripheral region, and wherein the apertures of the peripheral region form at least 60% of the total area of the holes of the distributor.

11. The burner according to claim 1, wherein the burner has a cylindrical shape, or has a convex profile.

12. The heating system according to claim 1, wherein the burner includes a central region and a peripheral region, the heating system further comprising a distributor located upstream the burner to feed the premixed air-gas to the burner, wherein the central region of the burner comprises an internal part and an external part, wherein the internal part is hole-free, and the external part of the central region is perforated, the external part of the central region of the burner being an annular zone surrounding the internal part of the central region, and wherein the internal part of the central region of the burner faces a perforated area of the distributor.

13. The heating system according to claim 12, wherein a central region of the distributor includes a central inner part and a central outer part, the central inner part and the central outer part being both perforated and separated by a zone free of holes, wherein the central outer part of the distributor faces the external part of the central region of the burner, and the central inner part of the distributor faces the inner part of the central region of the burner.

14. The heating system according to claim 13, wherein the external part of the central region of the burner is more extended than the central outer part of the distributor, such that the useful transit area of the burner is larger than that of the distributor.

15. A method for operating a premixed gas heating system capable of modulating between a minimum and a maximum load, wherein the ratio of the maximum load over the minimum load is at least 4, the method comprising the following steps:

providing a fan assembly configured to supply a premixed air-gas flow required for combustion;

supplying a premix of combustible gas and air to the burner, wherein combustible gas of said premixed air-gas flow contains at least 20% by volume of hydrogen;

providing a burner including a plurality of holes, wherein the plurality of holes provides a free passage area defined as an area that allows the outflow of the premixed air-gas flow from an area upstream the burner to an area where combustion flames are generated;

providing a load controller, configured to regulate an output load of the heating system such that the heating system modulates between the minimum load and the maximum load; and setting a value of minimum load such that a combustion index value is within the range between 4 E06 and 6 E07, the combustion index being defined as the ratio of the minimum load over the free passage area of the burner;

providing a user with a plurality of operating modes, wherein each operating mode of the plurality of operating modes corresponds to a respective range of the plurality of reference ranges;

selecting a reference range for the combustion index, from a plurality of reference ranges for the value of the combustion index, responsive to the operating mode selected by the user; and setting the minimum load to a value within the selected reference range.

16. The method according to claim 15, further comprising a step of providing the burner with a first group of holes and a second group of holes wherein the second group of holes has a diameter increased by at least 30% with respect to the first group of holes and wherein an area covered by the second group of holes is less than 40% of the total free passage area of the burner.

17. The method according to claim 15, further comprising the following steps:

providing the burner with a hole free peripheral region;

providing a distributor including a peripheral region having apertures and a central region having a plurality of holes wherein the apertures of the peripheral region form at least 60% of the total area of the holes of the distributor; and arranging the distributor upstream from the burner to feed the premixed air-gas to the burner and being arranged so that the peripheral region of the distributor faces the peripheral region of the burner.

18. A premixed gas heating system, comprising:

a fan assembly configured to supply a premixed air-gas flow required for combustion, wherein a combustible gas of the premix air-gas flow contains at least 20% by volume of hydrogen;

a burner including a plurality of holes, wherein the plurality of holes provides a free passage area defined as an area that allows the outflow of the premixed air-gas flow from a feeding chamber upstream the burner to a combustion chamber where combustion flames are generated; and a load controller, configured to regulate an output load of the burner such that the heating system modulates between a minimum load and a maximum load, wherein a ratio between the maximum load and the minimum load is at least 4, wherein the minimum load of the heating system is set such that a combustion index ranges between 4 E06 and 6 E07, the combustion index being defined as the ratio of the minimum load over the free passage area of the burner, wherein the burner includes a central region and a peripheral region, and wherein the central region is perforated whilst the peripheral region is hole-free, and further comprising a distributor including a peripheral region provided with apertures, the distributor being located upstream the burner to feed the premixed air-gas to the burner and being arranged so that the peripheral region of the distributor faces the peripheral region of the burner.

19. The premixed gas heating system of claim 18, wherein the plurality of holes of the burner includes a first group of holes having a first diameter and a second group of holes having a second diameter, the first diameter being smaller than the second diameter.

20. The premixed gas heating system of claim 18, wherein the central region of the burner comprises an internal part and an external part, wherein the internal part is hole-free, and the external part of the central region is perforated, the external part of the central region of the burner being an annular zone surrounding the internal part of the central region, and wherein the internal part of the central region of the burner faces a perforated area of the distributor.

* * * * *